US006131555A

United States Patent [19]

Tozzi et al.

[11] Patent Number: 6,131,555

[45] Date of Patent: Oct. 17, 2000

[54] SYSTEM FOR CONTROLLING IGNITION ENERGY OF AN INTERNAL COMBUSTION ENGINE

[75] Inventors: Luigi P. Tozzi, Columbus, Ind.; Stephen Goldschmidt, Huntsville, Ala.; David A. Everett, Scottsburg; Bryan S. Gatewood, Westport, both of Ind.

[73] Assignee: Cummins Engine Company, Inc., Columbus, Ind.

[21] Appl. No.: 09/328,551

[22] Filed: Jun. 9, 1999

Related U.S. Application Data

[63] Continuation-in-part of application No. 09/063,142, Apr. 20, 1998.

[51] Int. Cl.[7] ..... F02P 3/04

[52] U.S. Cl. ..... 123/618; 123/623; 123/637; 123/625

[58] Field of Search ..... 123/618, 620, 123/621, 624, 651, 653, 654, 644, 143 R, 636, 637, 623, 625, 650; 361/263

[56] References Cited

U.S. PATENT DOCUMENTS

| | | | |
|---|---|---|---|
| 3,368,540 | 2/1968 | Ault . | |
| 3,718,124 | 2/1973 | Burley . | |
| 4,077,377 | 3/1978 | Jundt et al. . | |
| 4,117,818 | 10/1978 | Bodig et al. . | |
| 4,303,977 | 12/1981 | Kobashi et al. . | |
| 4,506,650 | 3/1985 | Shimojo et al. . | |
| 4,512,303 | 4/1985 | Watanabe . | |
| 4,639,871 | 1/1987 | Sakai et al. . | |
| 4,862,370 | 8/1989 | Arnold et al. . | |
| 4,886,037 | 12/1989 | Schleupen . | |
| 4,915,086 | 4/1990 | Ciliberto et al. | 123/625 |
| 4,969,439 | 11/1990 | Scotson . | |
| 4,996,967 | 3/1991 | Rosswurm et al. . | |
| 5,038,744 | 8/1991 | Martin et al. . | |
| 5,197,448 | 3/1993 | Porreca et al. . | |
| 5,247,919 | 9/1993 | Akaki et al. . | |
| 5,255,209 | 10/1993 | Krebs . | |
| 5,327,320 | 7/1994 | Fischer . | |
| 5,404,853 | 4/1995 | Ishigami et al. . | |
| 5,513,618 | 5/1996 | Rich et al. . | |
| 5,555,862 | 9/1996 | Tozzi . | |
| 5,619,959 | 4/1997 | Tozzi . | |
| 5,623,412 | 4/1997 | Masson et al. . | |
| 5,668,311 | 9/1997 | Kiess et al. . | |
| 5,886,476 | 3/1999 | Skinner et al. . | |
| 5,947,093 | 9/1999 | Ward | 123/598 |

*Primary Examiner*—Henry C. Yuen
*Assistant Examiner*—Arnold Castro
*Attorney, Agent, or Firm*—Baker & Daniels

[57] ABSTRACT

A system for controlling ignition energy of an internal combustion engine includes an ignition coil having a primary coil and a secondary coil coupled to first and second electrodes of an ignition plug defining a spark gap therebetween, wherein the primary coil is operable to induce a spark voltage across the secondary coil and across the spark gap. The secondary coil is responsive to the spark voltage to produce a discharge current across the spark gap of the ignition plug. In accordance with one aspect of the invention, means are provided for controllably shunting the primary coil to thereby control the duration of discharge current across the spark gap of the ignition plug. In accordance with another aspect of the present invention, means are further provided for drawing discharge current away from the ignition plug to thereby limit the magnitude of the discharge current within some time period after the transfer of energy from the primary coil to the secondary coil begins. The principles of the present invention are accordingly applicable to control the duration and/or magnitude of ignition plug discharge current to thereby minimize electrode erosion while maximizing ignitability in either a conventional ignition plug-based ignition system or an arc propelling ignition plug-based ignition system.

14 Claims, 12 Drawing Sheets

PRIMARY CURRENT (A)
350
$T_0$
$T_1$
TIME

SECONDARY VOLTAGE (kV)
$V_{BD}$
352
354
356
$T_0$
$T_1$
$T_2$
$T_3$
$T_4$
TIME

SECONDARY CURRENT (A)
$I_P$
$I_L$
358
360
362
$T_0$
$T_1$
$T_X$
$T_2$
$T_3$
$T_4$
TIME

SYSTEM FOR CONTROLLING IGNITION ENERGY OF AN INTERNAL COMBUSTION ENGINE

CROSS-REFERENCE TO RELATED U.S. APPLICATION

The present invention is a continuation-in-part of co-pending U.S. patent application Ser. No. 09/063,142, filed Apr. 20, 1998 and entitled CONTROLLED ENERGY IGNITION SYSTEM FOR AN INTERNAL COMBUSTION ENGINE.

FIELD OF THE INVENTION

The present invention relates generally to ignition systems for internal combustion engines, and more specifically to controlling spark energy in such systems.

BACKGROUND OF THE INVENTION

In conventional inductive ignition systems for internal combustion engines, spark plug discharge current is typically characterized by an initial high current peak followed by a subsequent current decay. An example of such a conventional discharge current waveform 150 is illustrated in FIG. 8. One known problem associated with the operation of conventional spark plugs is electrode erosion caused by excessive discharge currents and/or excessive discharge current duration. In either or both cases, electrode erosion leads to poor or at least reduced engine operational efficiency and, eventually, spark plug failure.

Another class of ignition systems include specially configured spark plugs which are operable to propel the arc away therefrom to facilitate combustion of lean air-fuel mixtures and reduce electrode erosion rate. One example of such a spark plug includes a magnet positioned about the electrodes, wherein the magnetic field is operable to propel the arc outwardly from the plug. One embodiment of such a spark plug is described in U.S. Pat. Nos. 5,555,862 and 5,619,959 to Tozzi, which are assigned to the assignee of the present invention, and the disclosures of which are incorporated herein by reference. With such spark plugs of this nature, two key goals are to maximize the ability to ignite fuel at lean air-fuel mixtures while also maximizing electrode life. Unfortunately, the conventional discharge current waveform 150 illustrated in FIG. 8 is not optimized to further either of these goals. Excessive discharge current too early in the ignition event results in excessive electrode erosion while inadequate discharge current near the end of the ignition event results in poor combustion.

What is therefore needed in either a conventional or an arc-propelling spark plug based ignition system is a technique for controlling spark plug discharge current magnitude and/or duration to thereby maximize electrode life, and in an arc-propelling spark plug based system a technique for further controlling spark plug discharge current near the end of an ignition event to thereby maximize the ability to ignite fuel and lean air-fuel mixtures.

SUMMARY OF THE INVENTION

The foregoing shortcomings of the prior art are addressed by the present invention. In accordance with one aspect of the present invention a system for controlling ignition energy of an internal combustion engine comprises an ignition coil having a primary coil coupled to a secondary coil, the primary coil responsive to a control voltage to induce a spark voltage across the secondary coil, means responsive to a shunting signal for electrically shorting the primary coil, and a control computer producing the shunting signal after the spark voltage is induced across the secondary coil, wherein the primary coil is thereafter operable to absorb the spark voltage and accordingly reduce a duration of the spark voltage induced across the secondary coil.

One object of the present invention is to provide an improved ignition system for an internal combustion engine.

Another object of the present invention is to provide such an ignition system operable to control discharge current to thereby minimize electrode erosion.

These and other objects of the present invention will become more apparent from the following description of the preferred embodiments.

DESCRIPTION OF THE PREFERRED EMBODIMENTS

Figure 1:
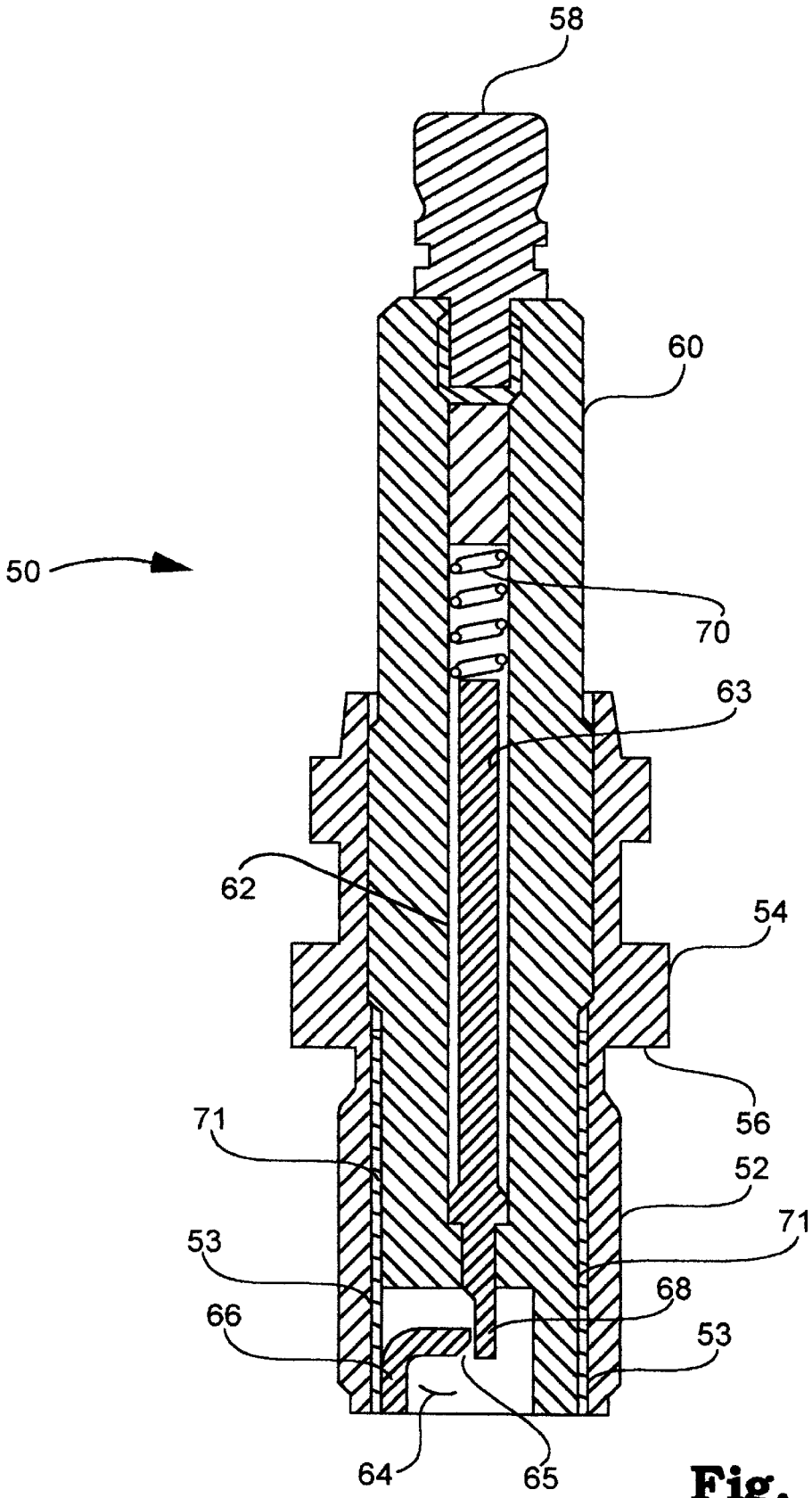
Fig. 1 (Prior Art)
FIG. 1 is a cross-sectional diagram of one prior art spark plug for use with the present invention.
Figure 2:
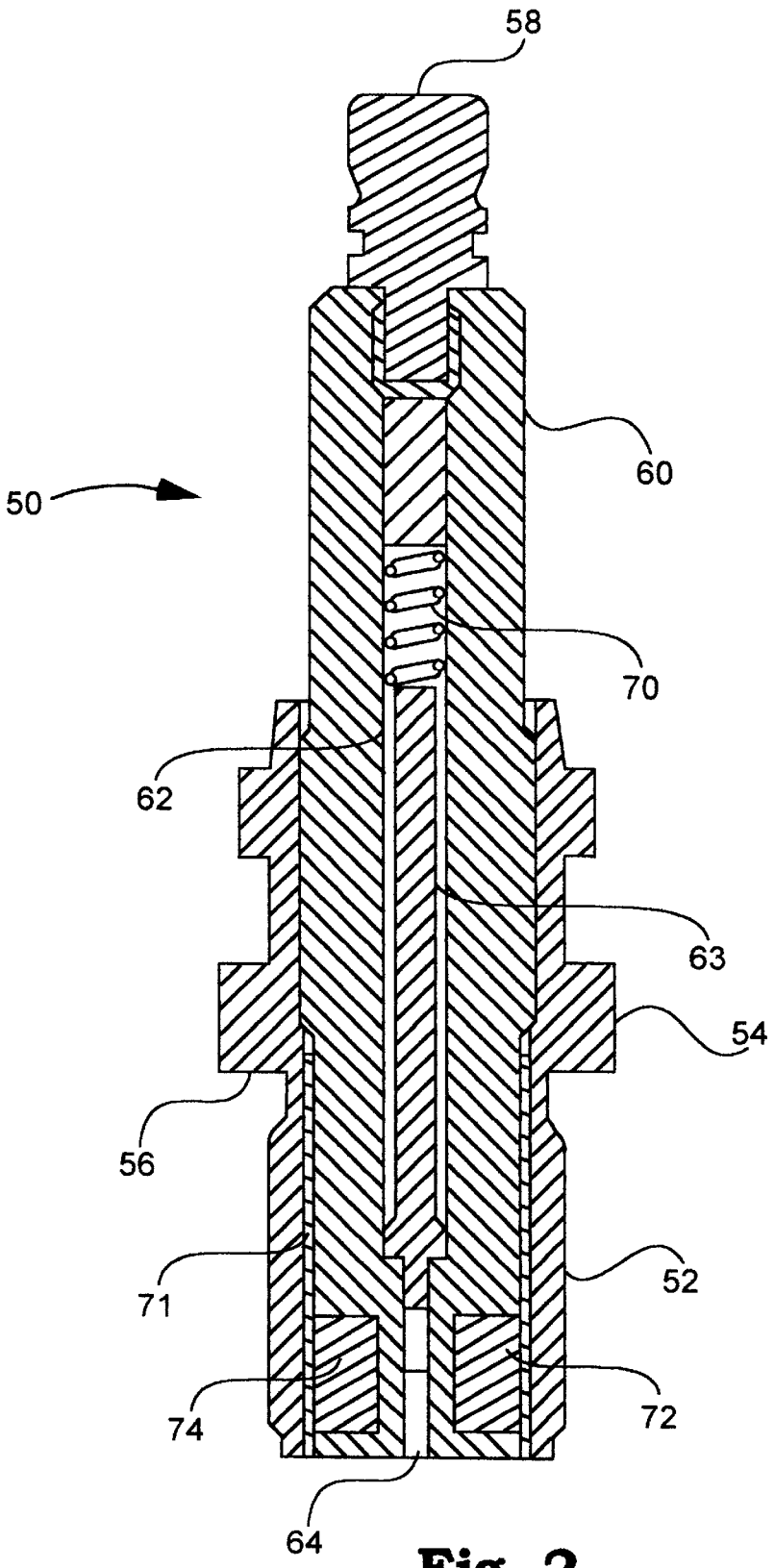
Fig. 2 (Prior Art)
FIG. 2 is a cross-sectional diagram of the spark plug of FIG. 1 viewed from a plane 90 degrees rotated from that of FIG. 1.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIGS. 1–4, an example of one prior art arc-propelling spark plug 50 for use with the spark discharge current control techniques of the present invention is illustrated. In FIG. 1, spark plug 50 includes a housing 54, typically formed of a metallic material, having a threaded portion 52. Threaded portion 52 enables mounting of spark plug 50 within a mating threaded hole in a cylinder block of an internal combustion engine (not shown). Surface 56 of housing 54 mates with a surface of the cylinder block or cylinder head to form an airtight seal with the combustion chamber formed within the cylinder block. Terminal electrode 58 is positioned within a bore 62 of an insulator 60, typically ceramic or similar material, and insulator 60 is fitted into housing 54. A distal end of housing 54 and insulator 64 forms a cavity 64 having a first electrode 66 and a second electrode 68 formed therein. Electrode 66 is attached to housing 54 in a known manner and electrode 68 is preferably electrically connected to terminal electrode 58 via electrode extension 63 and spring 70. In any case, electrodes 66 and 68 form a diverging gap 65 therebetween.

Magnets 72 and 74 (FIG. 2) are positioned within insulator 60 and generally surround the cavity 64. Magnets 72 and 74 produce a magnetic field within cavity 64, and hence within spark gap 65, which is operable to urge an arc established between electrodes 66 and 68 within gap 65 outwardly toward the end of the spark plug 50 as will be described in greater detail hereinafter.

Insulator 60 is preferably made from silicon nitride. Magnets 72 and 74 are preferably made from samarium cobalt, and housing 54 is made from materials typically used in spark plug construction, such as steel or the like. Electrode 58 is preferably made from nickel and electrodes 66 and 68 are preferably made from precious metal materials resistant to arc erosion well known in the art of spark plug construction.

Insulator 60 is not a perfect thermal insulator and a heat sink sleeve 71 is preferably provided between magnets 72 and 74 and an inner surface 53 of housing 54 to draw heat, generated in the combustion process, away from magnets 72 and 74 toward housing 54. Preferably, sleeve 71 is formed of a material having high thermal conductivity such as copper or the like.

Figure 3:
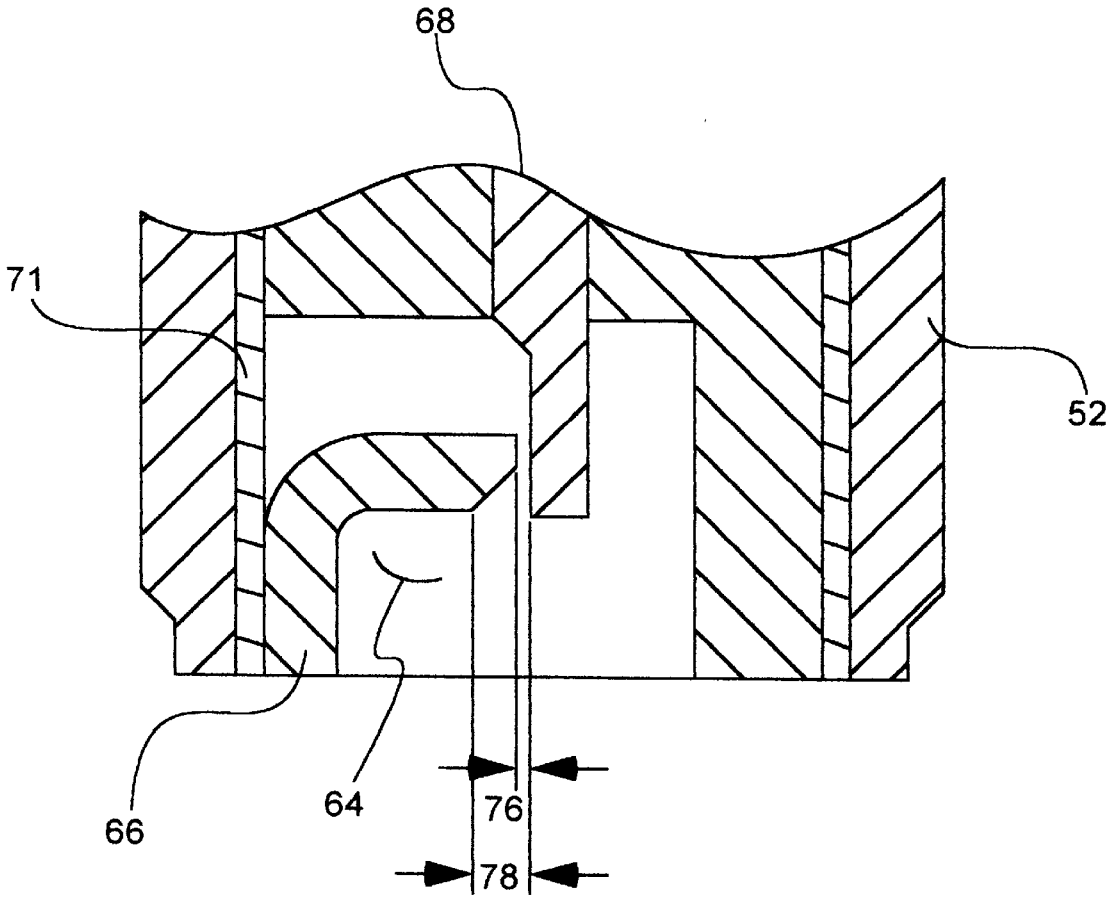
Fig. 3 (Prior Art)
FIG. 3 is a magnified view of the electrodes of the spark plug of FIG. 1.
Figure 4:
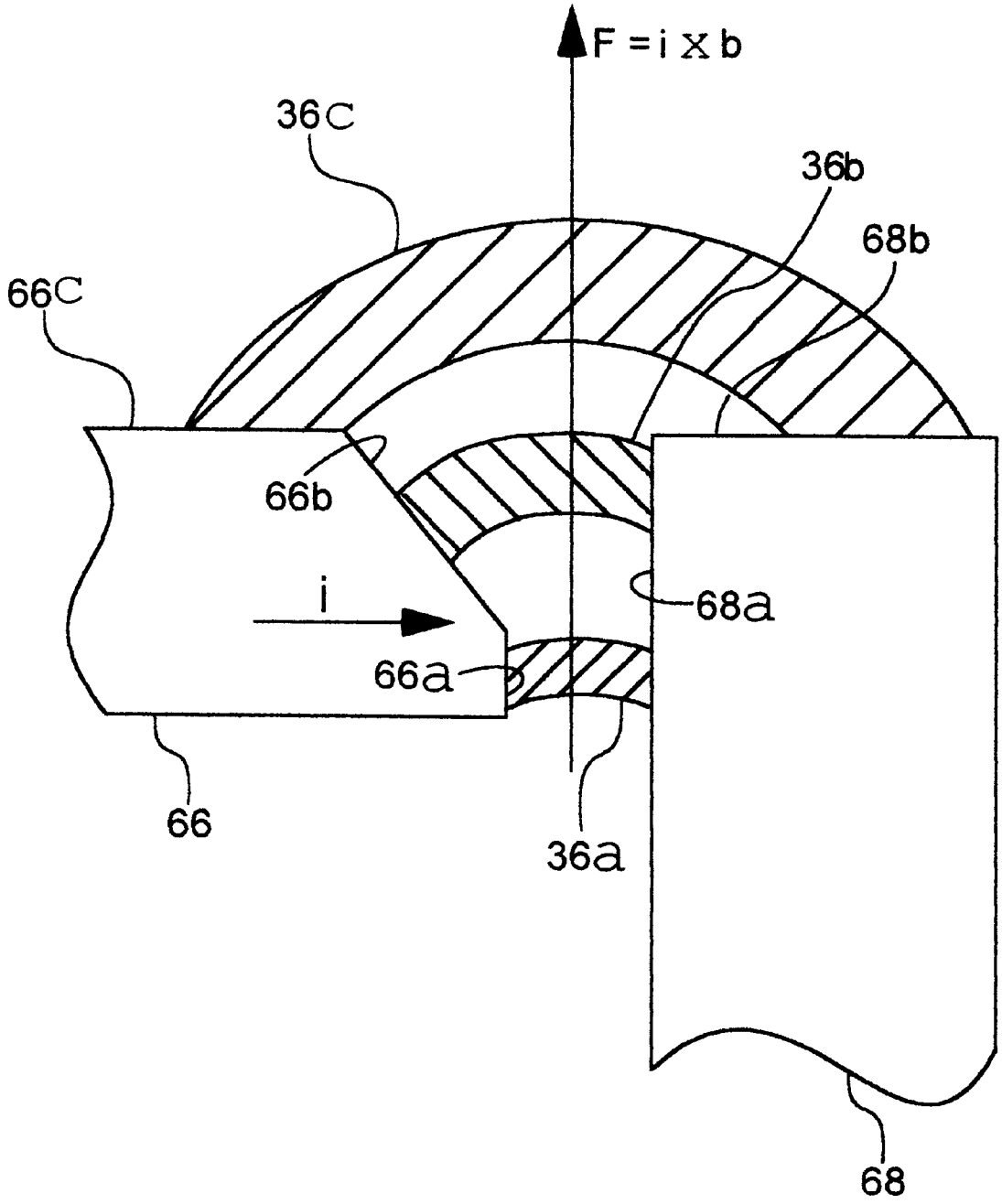
Fig. 4 (Prior Art)
FIG. 4 is a magnified view of the electrodes shown in FIG. 3 depicting the flow of current therebetween as the arc is propelled toward the electrode ends.

Referring now to FIG. 3, an enlarged view of electrodes 66 and 68 are shown. The spark gap formed between electrodes 66 and 68 has a narrow gap 76 that diverges to a larger spark gap 78 due to the configuration of electrode 66. Referring to FIG. 4, an enlarged view of electrodes 66 and 68 are shown. Various arcs 36*a*–36*c* are shown to depict the relative position of an arc created and established between electrodes 66 and 68 in accordance with various duration levels of ignition signals delivered to terminal 58 of spark plug 50. In particular, the arc 36*a* is established when a breakdown of the molecules occurs between surfaces 66*a* and 68*a* of electrodes 66 and 68 respectively, thereby generating a plasma area wherein current flow can be established. The plasma contains ions which enable or provide a conduit for current flow. Breakdown of the air gap 76 between surfaces 66*a* and 68*a* is accordingly often referred to as gap ionization. Once gap ionization occurs, current flow is established in the plasma area created by the ionization event, and arc 36*a* is accordingly established. When the resistance of the air gap 76 is broken down resulting from the ionization event, the voltage required to sustain arc 36*a* typically falls off from the voltage required to establish the arc.

Arc 36*a* may be urged toward the position between surface 66*b* of electrode 66 and surface 68*a* of electrode 68, designated by the arc 36*b*, by increasing the level and/or duration of the current I flowing into electrode 66. Likewise, the arc may be urged toward the position between the surface 66*c* of electrode 66 and surface 68*b* of electrode 68, designated by the arc 36*c*, by further increasing the level and/or duration of the current I flowing into electrode 66. In either case, inclusion of magnets 72 and 74 significantly reduces the amount of current required to suitably position the arc between electrodes 66 and 68. The force vector, depicted in FIG. 4 as F, is a graphical representation of the Lorentz force vector acting on arc 36*a*–*c* in accordance with the formula ixB. The diverging gap defined by electrodes 66 and 68 provides a means for establishing a variable length arc in a spark plug device, which is particularly advantageous with high pressure alternate fuel engines. An example of one such spark plug 50 is described in U.S. Pat. Nos. 5,555,862 and 5,619,959 to Tozzi, which are assigned to the assignee of the present invention, and the disclosures of which are incorporated herein by reference.

Figure 5:
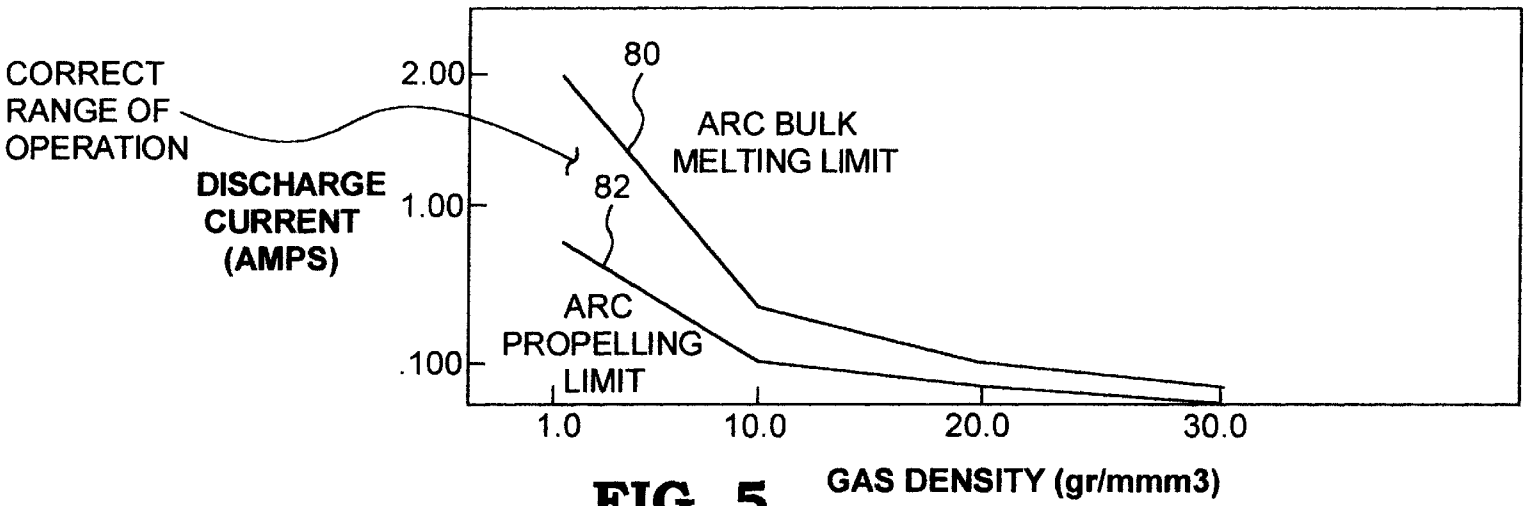
FIG. 5 is a plot of discharge current vs. gas density illustrating a preferred range of discharge current operation to prevent electrode damage while maintaining consistent arc propelling.
Figure 6:
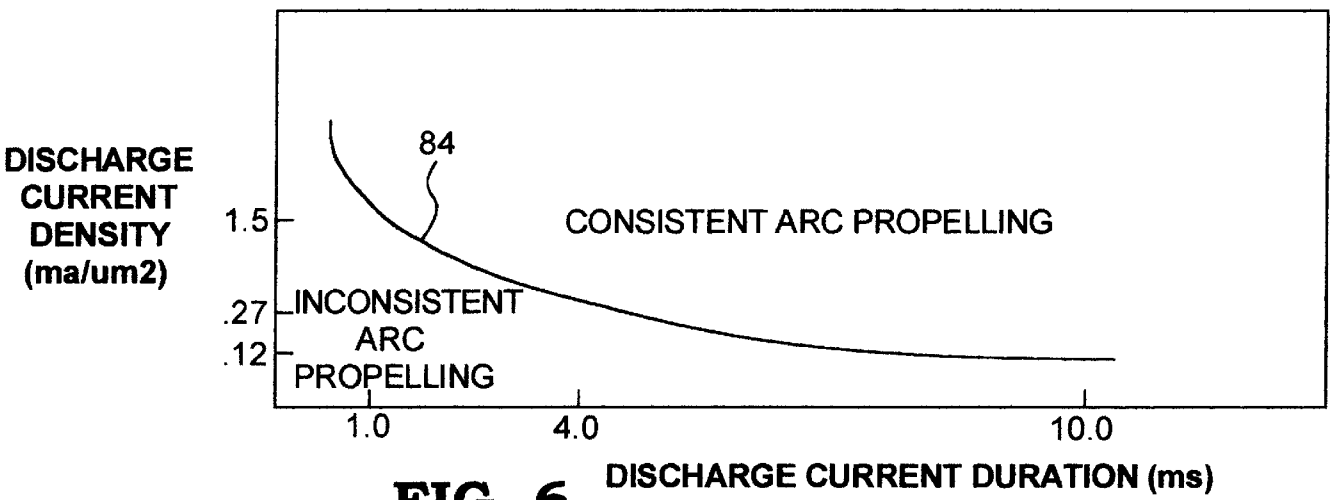
FIG. 6 is a plot of discharge current density vs. discharge current duration illustrating current density value required for consistent arc propelling.

Alternate fuel engines, particularly propane or natural gas engines, typically operate with lean air-fuel mixtures and cylinder pressures at combustion that may vary widely with engine load. Generally, cylinder pressure increases with engine load, and the diameter of arc 36*a*–*c* accordingly decreases. Thus, whereas the diameter of the arc at light engine load may result in acceptable surface temperatures of electrodes 66 and 68, the diameter of the arc decreases with an increase in engine load so that a correspondingly concentrated arc at high engine load may result in surface temperatures of electrodes 66 and 68 that exceed the melting point thereof. In accordance with the present invention, the current flowing between electrodes 66 and 68 is accordingly controlled to provide for a current density J that is less than a maximum current density above which electrode surface temperatures may exceed a melting point thereof under all engine load conditions. The current flowing between electrodes 66 and 68 must also be controlled to provide for a current density that is greater than a minimum current density below which inconsistent propelling of the arc 36*a*–*c* may occur. These two criteria are illustrated graphically in FIGS. 5 and 6. FIG. 5 shows discharge current, i of FIG. 4, plotted against gas density which is proportional to cylinder pressure. As illustrated in FIG. 5, waveform 80 marks the maximum discharge current boundary above which electrode surface temperatures may exceed a melting point thereof. Waveform 82 marks the minimum discharge current boundary below which inconsistent propelling of the arc 36*a*–*c* may occur. Between waveforms 80 and 82, an acceptable discharge current region is defined for the purposes of the present invention. FIG. 6 shows discharge current density plotted against discharge current duration. As evident from FIG. 6, the discharge current density 84 below which inconsistent arc propelling occurs is a decreasing function of time.

Within the acceptable discharge current region defined between waveforms 80 and 82 of FIG. 5, the present invention is concerned with minimizing erosion (due to excessive spark current or power discharge) of surfaces 66*a* and 66*b* of electrode 66, and of surface 68*a* of electrode 68 while maximizing the ability to ignite fuel at lean air-fuel mixtures. Surfaces 66*c* and 68*b* of electrodes 66 and 68 respectively generally do not contribute to the dimensions of the spark gap 76 and 78 (FIGS. 3 and 4), and concern over erosion of the surfaces thereof is accordingly lessened. In accordance with the present invention, the discharge current (i of FIG. 4) is preferably controlled to an optimum low current after gap ionization occurs, wherein the low current is just above a current level required for consistent arc propulsion. When the arc has traveled a specified distance along the diverging gap 65, the discharge current is gradually increased to an optimum current level at which ignition of the air-fuel mixture may occur. One preferred embodiment of a system 100 for accomplishing these objectives is illustrated in FIG. 7.

Figure 7:
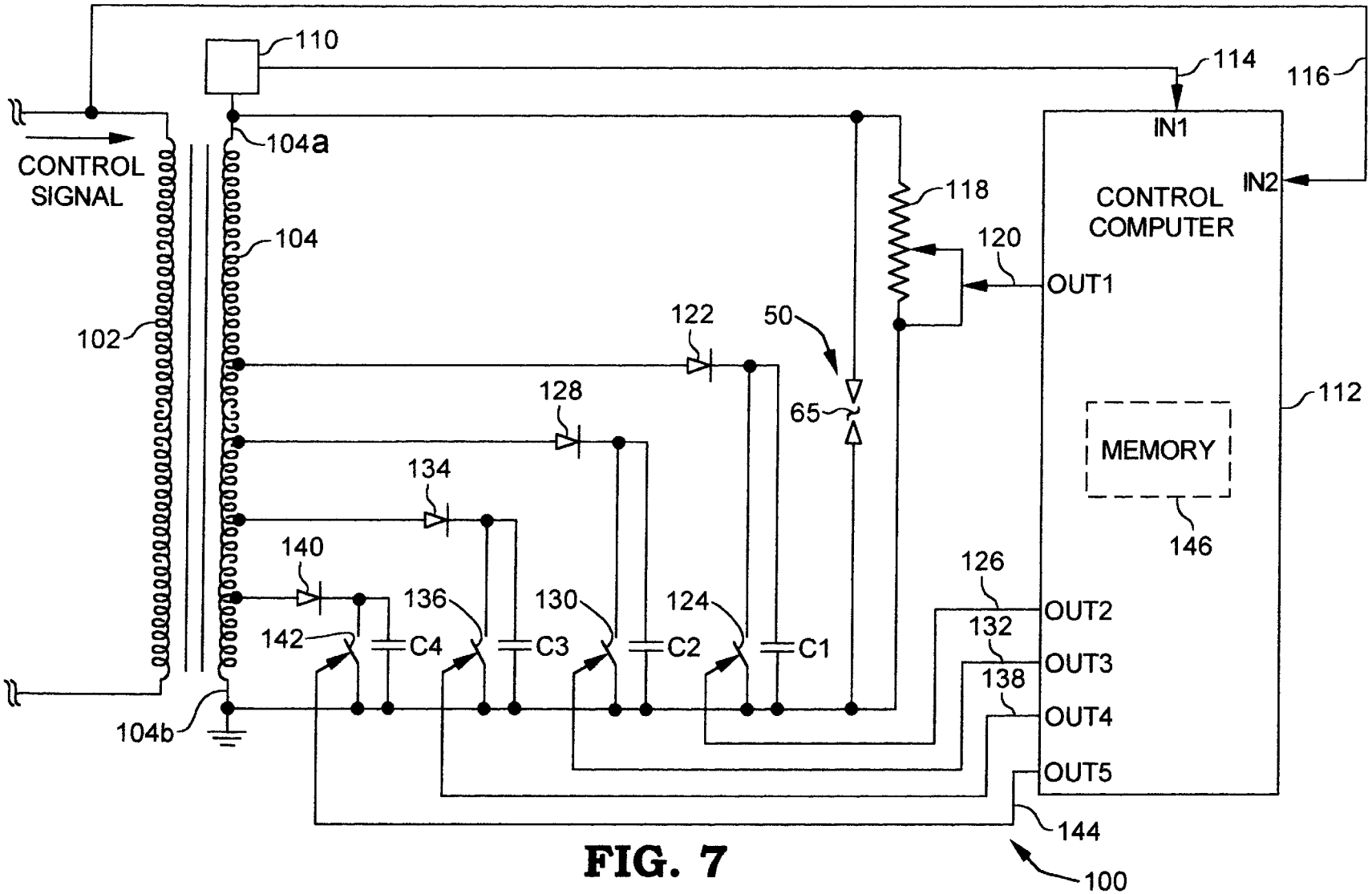
FIG. 7 is a diagrammatic illustration of one embodiment of the controlled energy ignition system of the present invention.

Referring now to FIG. 7, a controlled energy ignition system 100 includes an ignition coil having a primary coil 102 magnetically coupled to a secondary coil 104 as is known in the art. One end of the primary coil 102 receives a control signal for activating ignition system 100, and this control signal is provided to an input IN2 of a control computer 112 via signal path 116. Preferably, control computer 112 is microprocessor controlled and includes digital signal processing capabilities as well as a memory portion 146. One end 104*a* of secondary coil 104 is connected to one end of spark plug 50 and to one end of a variable resistor 118, and an opposite end 104*b* of secondary coil 104 is connected to ground potential, to an opposite end of spark plug 50 and to an opposite end of variable resistor 118. Output OUT1 of control computer 112 is connected to variable resistor 118 via signal path 120 for controlling the resistance thereof.

Variable resistor 118 is illustrated in FIG. 7 as a potentiometer having a wiper connected to one end thereof wherein control computer 112 is operable to control the position of the wiper via OUT1. It is to be understood that the structure of variable resistor 118 shown in FIG. 7 represents one embodiment thereof, and the present invention contemplates utilizing any known variable resistor structure controllable by control computer 112 to thereby adjust the value thereof. Examples of known resistor adjustment structures and techniques include, but are not limited to, zener diode controlled resistor structures, so-called R/2R ladder structures, and the like.

End 104*a* of secondary coil 104 is also connected to, or includes integral therewith, a voltage sensor 110 that is connected to input IN1 of control computer 112 via signal path 114. Voltage sensor 110 is preferably a known sensor such as that described in co-pending U.S. patent application Ser. No. 08/988,787 entitled APPARATUS AND METHOD FOR DIAGNOSING AND CONTROLLING AN IGNITION SYSTEM OF AN INTERNAL COMBUSION ENGINE, filed by Luigi Tozzi and assigned to the assignee of the present invention, the disclosure of which is incorporated herein by reference. It is to be understood, however, that for purposes of the present invention, voltage sensor 110 may be any known sensor operable to determine a breakdown voltage, $V_{BD}$, corresponding to the voltage required to ionize gap 65 of spark plug 50 as described hereinabove, and provide a corresponding signal to input IN1 of control computer 112.

The secondary coil 104 preferably includes a number of taps each coupled to a capacitor, wherein charging and discharging of the capacitors is controlled by control computer 112. Although four such taps and associated computer controlled capacitors are shown in FIG. 7, it is to be understood that system 100 may include any number of taps/capacitors, the purpose of which will be fully described hereinafter. In the embodiment illustrated in FIG. 7, a first tap to secondary coil 104 is connected to an anode of a diode 122, the cathode of which is connected to one end of a switch 124 and to one end of a capacitor C1. The opposite ends of switch 124 and capacitor C1 are connected to end 104*b* of coil 104. Output OUT2 of control computer 112 is connected to a switch control input of switch 124 via signal path 126 such that control computer 112 is operable to control the opening and closing of switch 124 via OUT2. A second tap to secondary coil 104 is connected to an anode of a diode 128, the cathode of which is connected to one end of a switch 130 and to one end of a capacitor C2. The opposite ends of switch 130 and capacitor C2 are connected to end 104*b* of coil 104. Output OUT3 of control computer 112 is connected to a switch control input of switch 130 via signal path 132 such that control computer 112 is operable to control the opening and closing of switch 130 via OUT3. A third tap to secondary coil 104 is connected to an anode of a diode 134, the cathode of which is connected to one end of a switch 136 and to one end of a capacitor C3. The opposite ends of switch 136 and capacitor C3 are connected to end 104*b* of coil 104. Output OUT4 of control computer 112 is connected to a switch control input of switch 136 via signal path 138 such that control computer 112 is operable to control the opening and closing of switch 136 via OUT4. A fourth tap to secondary coil 104 is connected to an anode of a diode 140, the cathode of which is connected to one end of a switch 142 and to one end of a capacitor C4. The opposite ends of switch 142 and capacitor C4 are connected to end 104*b* of coil 104. Output OUT5 of control computer 112 is connected to a switch control input of switch 142 via signal path 144 such that control computer 112 is operable to control the opening and closing of switch 142 via OUT5. Switches 124, 130, 136 and 140 may be any known electrically controllable switches, and in one embodiment, these switches are provided as MOSFET transistors.

One goal of the present invention is to control discharge current through the spark plug 50 in such a manner so as to minimize electrode erosion, thereby maximizing plug life, while maximizing the ability to ignite fuel at lean air fuel mixtures, thereby optimizing fuel combustion. Referring back to FIG. 4, minimization of electrode erosion is defined for the purposes of spark plug 50 as minimizing erosion, due to current conduction between electrodes 66 and 68, of electrode surfaces 66*a*, 66*b* and 68*a*. These surfaces define the dimensions of spark gap 65 and any erosion thereof results in alteration of these dimensions, which correspondingly affects engine performance and spark plug life. Controlled energy ignition system 100 is accordingly operable, in accordance with one aspect of the present invention, to minimize the spark plug discharge current for arcs 36*a* and 36*b* while also maintaining sufficient discharge current to permit consistent propelling of the arc upwardly toward the position indicated by arc 36*c*. Once the arc is positioned between surface 66*c* of electrode 66 and surface 68*b* of electrode 68, controlled energy ignition system 100 is operable, in accordance with another aspect of the present invention, to increase the spark plug discharge current to a level which permits optimum ignitability of the air-fuel mixture. Since surfaces 66*c* and 68*b* of electrodes 66 and 68 do not directly define any of the boundaries of spark gap 65, some erosion of surfaces 66*c* and 68*b* due to the increase in discharge current is tolerable and will generally not result in degraded engine performance or decreased plug life. The controlled energy ignition system 100 provides for such discharge current control, and details thereof will now be described with respect to FIGS. 7 and 8.

Figure 8:
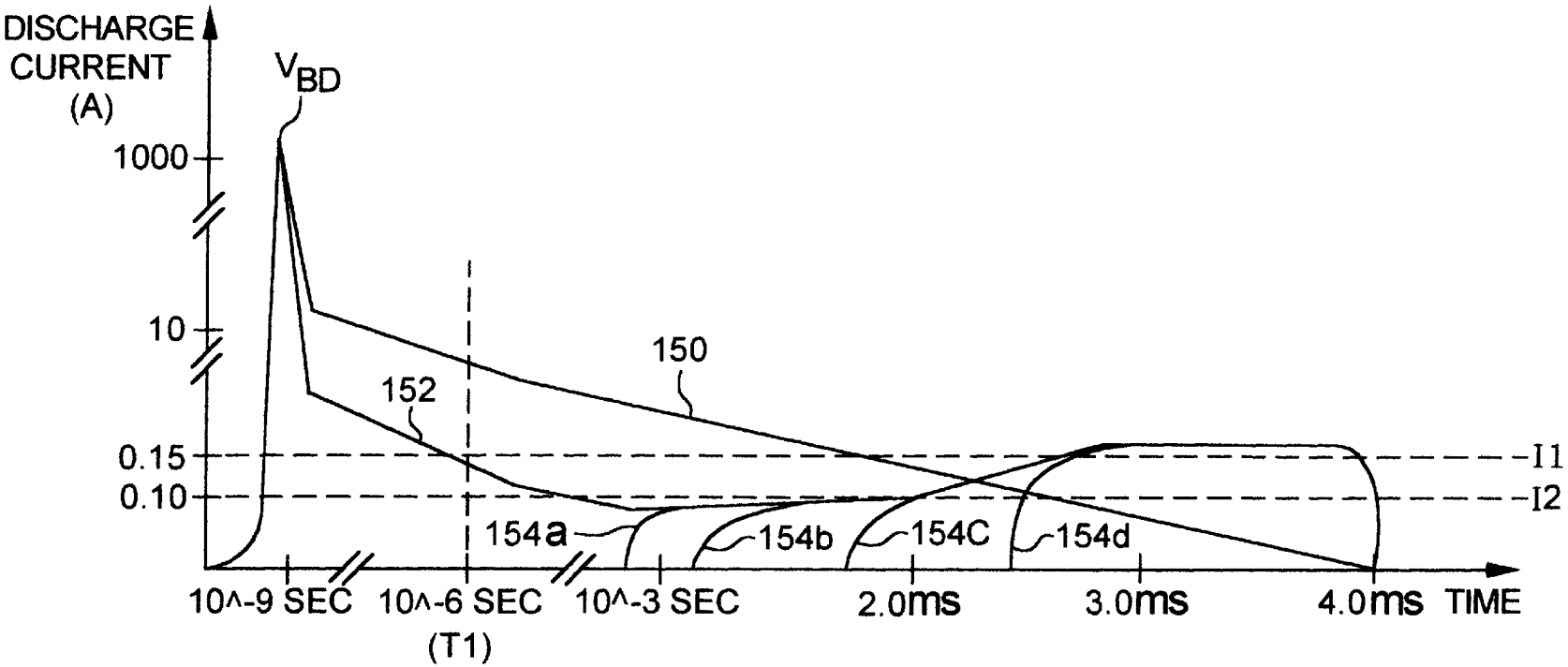
FIG. 8 is a plot of spark plug discharge current over time illustrating some of the spark energy control techniques of the present invention.

Referring specifically to FIG. 8, plot 150 represents a discharge current waveform resulting from a known inductive discharge ignition system as described hereinabove. It has been determined through experimentation that the peak discharge current between the spark plug electrodes, resulting in ionization of the spark gap 65 at a breakdown voltage of $V_{BD}$, generally does not cause significant electrode erosion if the duration thereof is short (e.g. on the order of fractions of nanoseconds). In other words, damage to electrode surfaces 66*a* and 68*b* is minimized if the duration of peak discharge current is short. It has further been determined through experimentation that the discharge current must subsequently be controlled to be below a first discharge current threshold I1 within some time period T1 after starting the ignition event in order to minimize discharge current-induced electrode erosion. The discharge current level must, however, be above a minimum current threshold I2 (which is less than I1) at time T1 in order to provide for subsequent propelling of the arc, under the influence of the magnetic field, in a consistent manner. In one embodiment of spark plug 50, I1=150 mA, I2=100 mA and T1 =1 ms, although the present invention contemplates other values depending upon the type and configuration of spark plug and corresponding spark gap.

In accordance with the present invention, system 100 is operable to control the decay of the discharge current after gap ionization to thereby achieve the desired current level of between I1 and I2 at time T1 as illustrated in the discharge current waveform 152 of FIG. 8. In one embodiment, control computer 112 is operable to provide such control by adjusting the value of the variable resistor 118 to thereby control the discharge current decay rate. As described hereinabove with respect to FIG. 5, the current density of the discharge current increases with increasing cylinder pressure, wherein cylinder pressure increases with engine load. Thus, as engine load varies, it is desirable to accordingly control the discharge current level to maintain the discharge current density below a level which results in excessive electrode surface temperatures while maintaining the discharge current density above a level which permits consistent propelling of the arc. Thus, control computer 112 is operable to control the discharge current level after gap ionization based on current engine load conditions to thereby minimize electrode erosion rate while providing for consistent propelling of the arc over all engine load conditions. In the embodiment shown in FIG. 8, control computer 112 is preferably operable to provide such control by first determining engine load, preferably by determining cylinder pressure based on $V_{BD}$ at gap ionization, mapping cylinder pressure to a desired value of variable resistor 118, and adjusting the value of variable resistor 118 to the desired value via output OUT1. Those skilled in the art will, however, recognize that other techniques may be used for relating engine load to discharge current level, and that such techniques may be used to adjust the value of the discharge current to some desired value or range of values within some time period after starting the ignition without deviating from the scope of the present invention.

Figure 9:
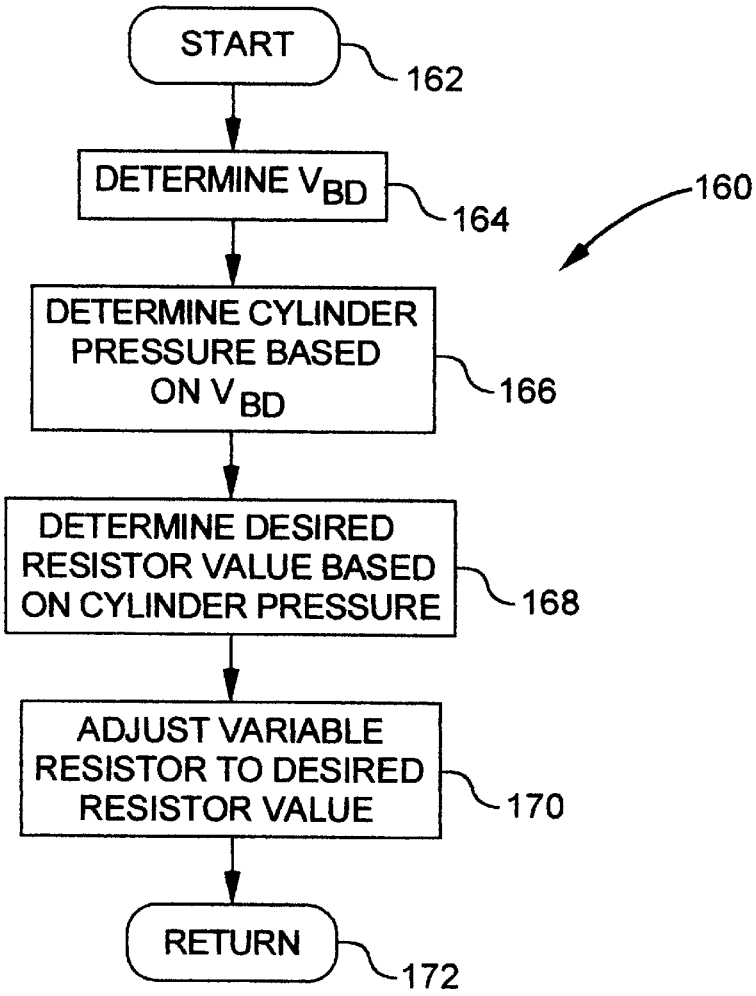
FIG. 9 is a flowchart illustrating one preferred embodiment of a software algorithm for controlling the discharge current to a desired current range following gap ionization.

Referring now to FIG. 9, one embodiment of a flowchart 160 for controlling discharge current level for a time period following gap ionization, in accordance with one of the techniques described above, is shown. Algorithm 160 is preferably executable by control computer 112 many times per second as is known in the art. Algorithm 160 begins at step 162 and at step 164, control computer 112 is operable to determine the breakdown voltage, $V_{BD}$, at gap ionization. Preferably, control computer 112 is operable to execute step 164 by processing the spark voltage waveform provided to input IN1 thereof by sensor 110, and determining $V_{BD}$ therefrom in accordance with known techniques. Thereafter at step 166, control computer 112 is operable to determine cylinder pressure based on $V_{BD}$. As is known in the art, cylinder pressure is proportional to engine load and cylinder pressure is related to $V_{BD}$ via Paschen's law:

$$V_{BD}K_1*(\text{gap})*(\text{pressure})/\ln(K_2*\text{gap}*\text{pressure}) \quad (1),$$

wherein $K_1$ and $K_2$ are constants, gap is the width of the spark gap 76 (FIG. 3) and pressure is the cylinder pressure. Computer 112 is preferably operable at step 166 to compute cylinder pressure based on equation (1).

Figure 10:
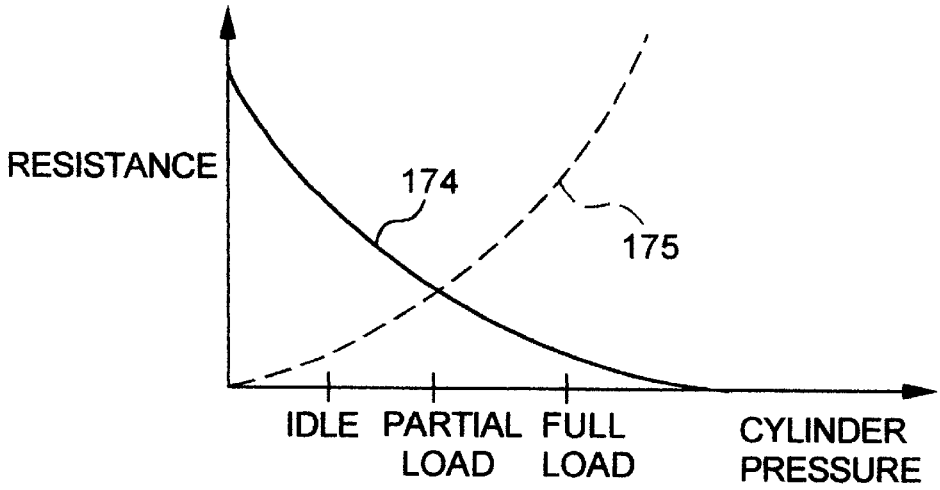
FIG. 10 is a plot of resistance vs. cylinder pressure illustrating one preferred technique for mapping current engine load to a desired resistor value for adjusting the variable resistor shown in FIG. 7.

Thereafter at step 168, control computer 112 is operable to determine a desired resistor value based on the cylinder pressure value determined in step 166. FIG. 10 illustrates one preferred technique for relating cylinder pressure to desired resistance value, wherein resistance 174 is plotted against cylinder pressure, and wherein engine load indicators are shown which correspond to associated cylinder pressure values. Thus, at no load, or idle, conditions, the desired resistor value is high, and the desired resistor value decreases, preferably according to a chosen function, as engine load increases. In an alternative embodiment, the resistance vs. cylinder pressure curve 175 may be used to relate cylinder pressure to a desired resistance value. It is to be understood, however, that the resistance vs. cylinder pressure relationship may take on any desired shape. In any event, the relationship between desired resistor values and cylinder pressure values is preferably stored within memory portion 146 of control computer 112, and may be represented therein as an equation (either continuous or piecewise continuous), a graph or plot as shown in FIG. 10, or as a look-up table. Control computer 112 is, in any case, operable at step 168 to map a current cylinder pressure value to a desired resistor value. Thereafter at step 170, control computer 112 is operable to adjust the value of the variable resistor 118 to the desired resistor value, using any one or more known techniques, some of which were described hereinabove. Algorithm execution continues from step 170 at step 172 where algorithm execution is returned to its calling routine, or alternatively loops back to step 164 for continuous execution of algorithm 160.

It should now be apparent that system 100 is, in accordance with one aspect thereof, operable to draw current away from spark plug 50 following gap ionization to thereby control the discharge current to within a desired range of discharge current values based on engine load conditions, gap structure and gap width.

Referring again to FIGS. 7 and 8, system 100 is further operable to controllably increase the discharge current to a current level suitable for igniting the air fuel mixture after the arc has reached the position illustrated by arc 36*c* of FIG. 4. As described hereinabove, some erosion of surfaces 66*c* and 68*b* is permissible since these surfaces do not form any of the boundaries of spark gap 65. Thus, as the time of air-fuel mixture ignition approaches, control computer 112 is preferably operable to increase the discharge current to a current level at which optimal igniting of the air-fuel mixture occurs. In one preferred embodiment, system 100 is operable to controllably increase the discharge current by sequentially controlling the positions of the various switches 124, 130, 136 and 140.

At the beginning of the ignition event, the control signal is applied to the primary coil 102 which induces a corresponding voltage in the secondary coil 104 and current through coil 104 increases rapidly, as is known in the art, until gap ionization occurs, after which the discharge current is controllably decreased as described above. As the gap ionization event occurs, switches 124, 130, 136 and 140 are all preferably open, thereby charging each of the capacitors C1–C4. Control computer 112 is operable to control each of the switches 124, 130, 136 and 140 at predetermined time intervals after the ignition event begins, wherein activation of the control signal marks the beginning of each ignition event, and control computer 112 is responsive to the control signal supplied thereto via input IN2 to establish a corresponding time mark. In one embodiment of spark plug 50 and corresponding internal combustion engine (not shown), it has been determined that the discharge current arc reaches the position indicated at 36*c* of FIG. 4 approximately 2.0 milli-seconds after the ignition event begins, and the actual air-fuel ignition event occurs between 3.0–4.0 milli-seconds after the ignition event begins. Control computer 112 is accordingly operable to controllably increase the discharge current level, via control of switches 124, 130, 136 and 140, such that the discharge current is set to a level at which optimal igniting of the air-fuel mixture occurs between 3.0–4.0 milli-seconds. With fast revving engines (i.e., RPM>600), however, these times and durations should be correspondingly reduced (up to 10 times or more) to prevent possible variations in the start of combustion.

In the embodiment illustrated in FIG. 7, control computer 112 is preferably operable to sequentially close switches 124, 130, 136 and 140 to thereby cause the voltage stored in each of the capacitors to be impressed across corresponding portions of the windings of the secondary coil 104, thereby sequentially adding supplemental currents (represented by lines 154*a*, 154*b*, 154*c* and 154*d* in FIG. 8) to the discharge current. Thus, as illustrated in FIG. 8, control computer 112 is operable to close switch 124 just prior to 1.0 ms after the start of the ignition event, close switch 130 just after 1.0 ms after the start of the ignition event, close switch 136 just prior to 2.0 ms after the start of the ignition event, and close switch 140 just after 2.0 ms after the start of the ignition event. The resulting effect is to ramp the discharge current 152 to approximately 170 mA between 3.0–4.0 ms after the start of the ignition event, which corresponds to the actual time of igniting the air-fuel mixture. It is to be understood that the foregoing description is illustrative of only one particular application of the discharge current increasing technique of the present invention, and that the present invention contemplates providing for the desired ignition discharge current at any time interval following commencement of the ignition event, and by using any number of capacitor/switch combinations. Those skilled in the art will recognize that the number of capacitor/switch combinations used will be dictated by the desired shape of the discharge current waveform 152 leading up to air-fuel mixture ignition.

Figure 11:
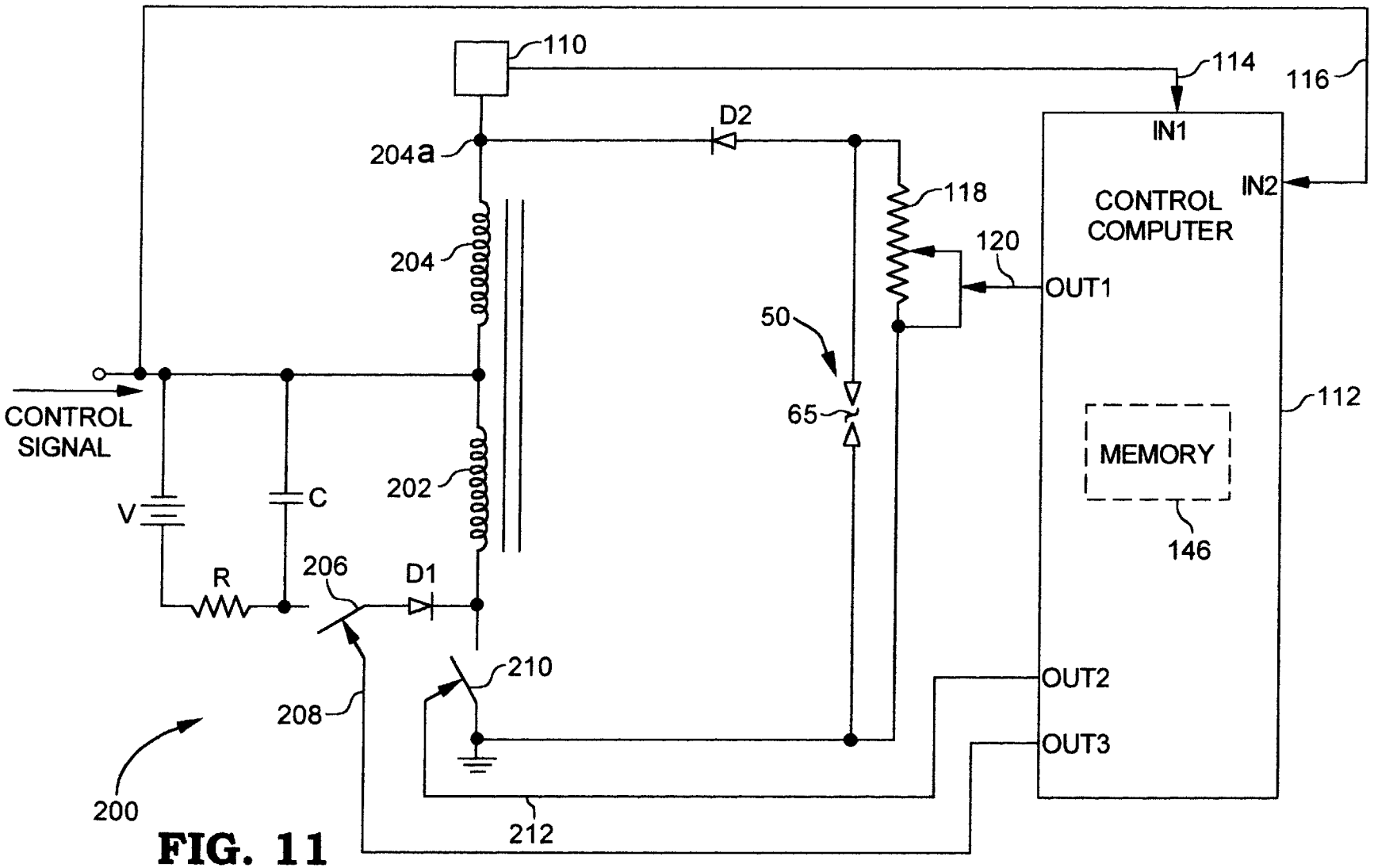
FIG. 11 is a diagrammatic illustration of an alternate embodiment of the controlled energy ignition system of the present invention.

Referring now to FIG. 11, an alternate embodiment of a controlled energy ignition system 200, in accordance with the present invention, is shown. System 200 is identical in many respects to system 100 of FIG. 7, and like numbers are accordingly used to identify like elements. Unlike elements of system 200 include an ignition coil having a primary coil 202 inductively coupled to a secondary coil 204 as is known in the art. One end of the primary coil 202 is connected to a capacitor C, to one end of a voltage source V and to one end of the secondary coil 204, and receives a control signal for activating system 200. The opposite end of the capacitor C is connected to one end of a switch 206 and to one end of a resistor R. The opposite end of the resistor R is connected to an opposite end of the voltage source V, and the opposite end of the switch 206 is connected to the anode of a diode D1, the cathode of which is connected to an opposite end of the primary coil 202 and to one end of a second switch 210. A control input to switch 206 is connected to an output OUT2 of control computer 112 via signal path 208. The opposite end of switch 210 is connected to ground potential and to one end of spark plug 50 and variable resistor 118. A control input to switch 210 is connected to an output OUT3 of control computer 112 via signal path 212. End 204*a* of secondary coil 204 is connected to voltage sensor 110 and to a cathode of a second diode D2, the anode of which is connected to opposite ends of spark plug 50 and variable resistor 118. The remaining structure illustrated in FIG. 11 is identical to like numbered components described with respect to FIG. 7.

Figure 12:
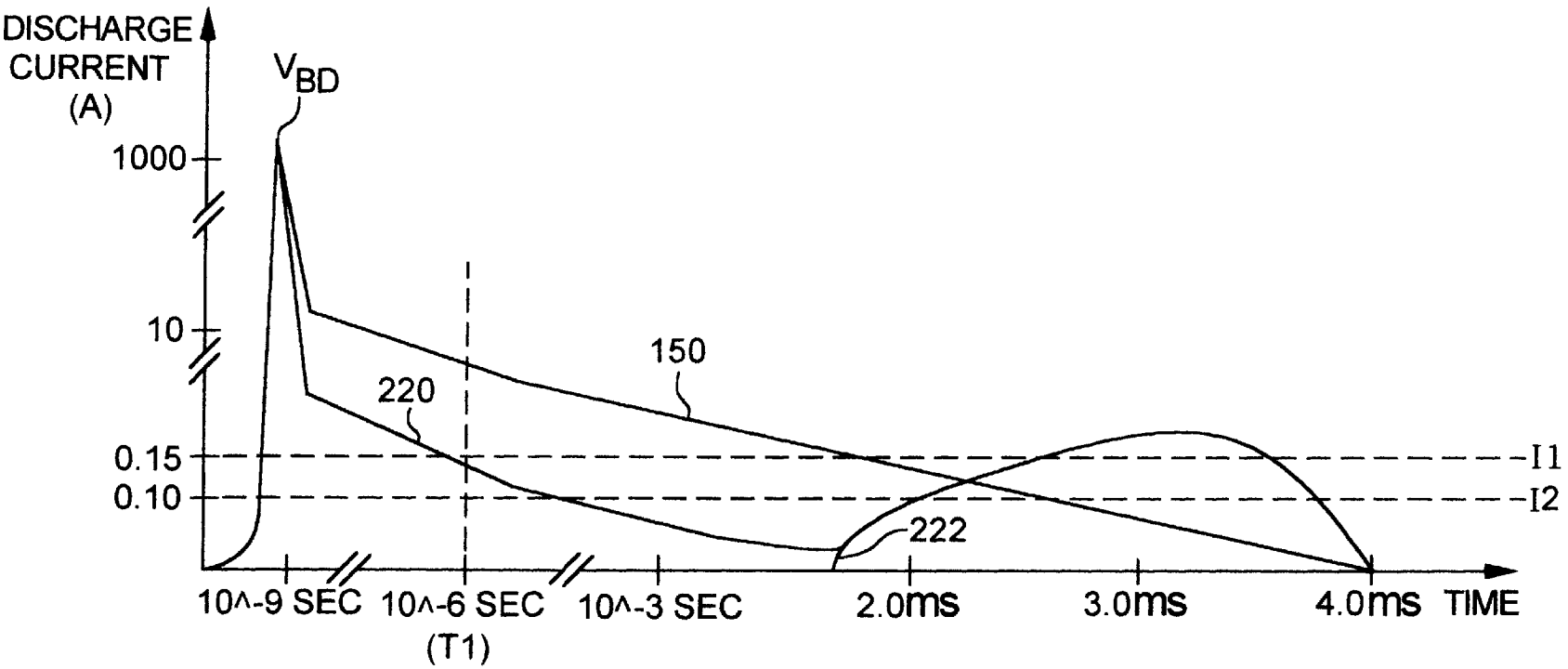
FIG. 12 is a plot of spark plug discharge current vs. time for the system shown in FIG. 11 illustrating some of the spark energy control techniques of the present invention.

In operation, control computer 112 is responsive to the control signal provided at input IN1 thereof to close switch 210 which completes the coil circuit and causes the spark plug discharge current 220, as illustrated in FIG. 12, to rise. System 200 is preferably operable to control the decrease of the discharge current after gap ionization as described hereinabove, so that the discharge current level is between I1 and I2 at a time T1 after starting the ignition event. Thereafter, the discharge current 220 continues to decay until sometime between 1.0–2.0 ms after starting the ignition event, when the control computer 112 is operable to close switch 206, thereby causing the voltage on capacitor C, which was pre-charged to a suitable voltage by voltage source V, to be impressed upon the primary coil 202. This induces an additional or supplemental current in the secondary coil 204, resulting in an approximately sinusoidal increase in the discharge current 220 as indicated at 222 in FIG. 12. System 200 is thus operable to increase the discharge current to a suitable level for igniting the air-fuel mixture at a desired time range after starting the ignition event. Unlike system 100, however, system 200 is operable to provide this capability by controllably impressing additional voltage on the primary coil 202 rather than on the secondary coil 104 as in system 100. Both systems produce the expected results, although system 200 is less complicated in that it does not require high voltage capacitors (which would typically be required for capacitors C1–C4 of system 100), and does not require configuring the secondary coil 204 for multiple tap locations. It is to be understood that the foregoing description is illustrative of only another particular application of the discharge current increasing technique of the present invention, and that the present invention contemplates providing for the desired ignition discharge current at any time interval following commencement of the ignition event, and by using any number of capacitor/switch combinations. Those skilled in the art will recognize that the number of capacitor/switch combinations used will be dictated by the desired shape of the discharge current waveform 220 leading up to air-fuel mixture ignition.

While the present invention has been described as being directed to techniques for controlling the discharge current in a diverging gap spark plug having means for magnetically propelling the arc along the diverging gap, those skilled in the art will recognize that the concepts described herein are applicable to controlling the shape of the discharge current in ignition systems having conventional spark plugs as well, and that control of such systems is intended to fall within the scope of the present invention.

Figure 13:
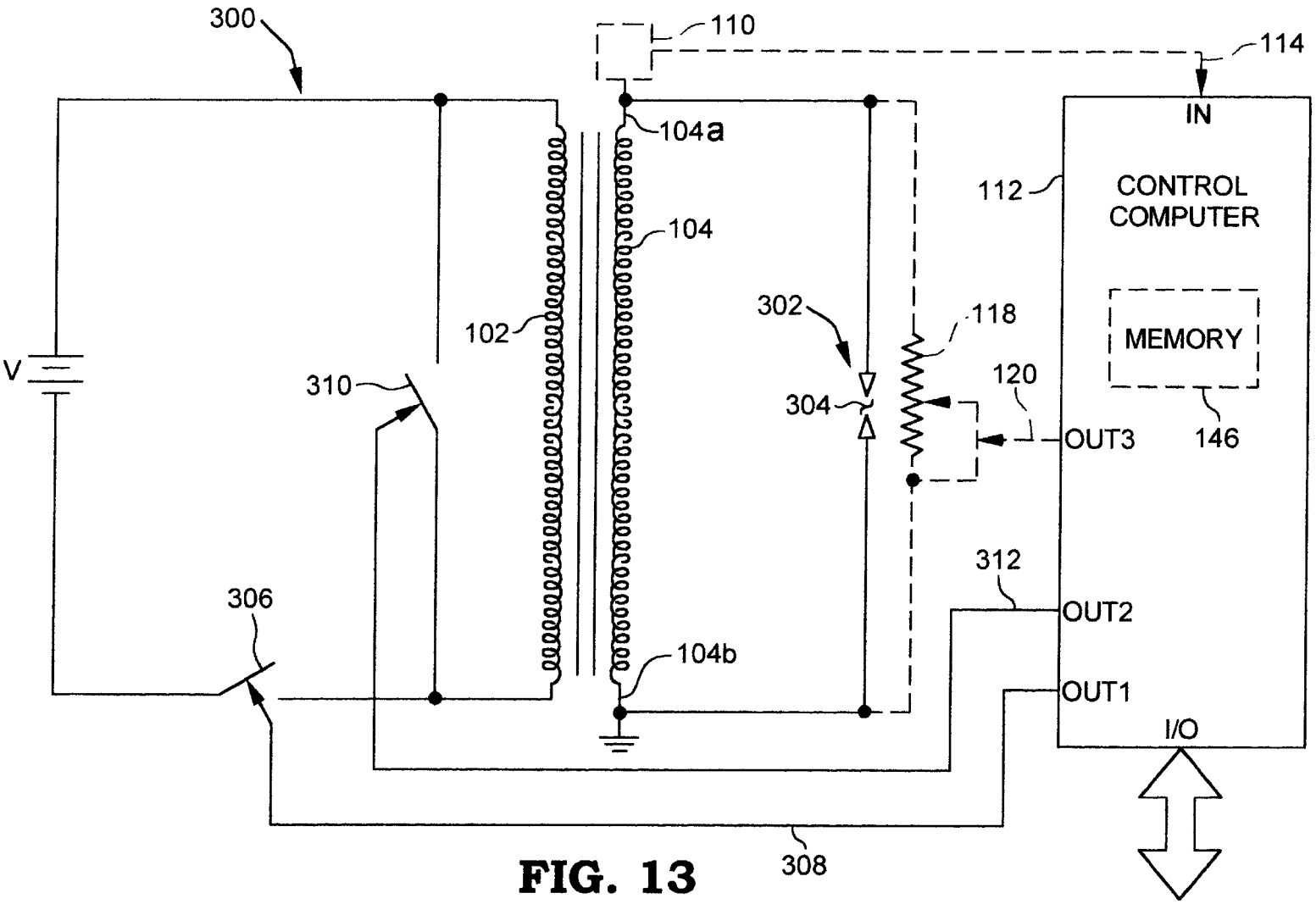
FIG. 13 is a diagrammatic illustration of another alternate embodiment of the controlled energy ignition system of the present invention.

Referring now to FIG. 13, one embodiment of a system 300 for controlling ignition energy, in accordance with an another aspect of the present invention, is shown. One key goal in developing an alternatively fueled engine is to provide for performance commensurate with a conventional engine, such as a diesel engine, regardless of the type of fuel used. Often times, achievement of this goal requires increasing the engine's cylinder pressure which correspondingly increases demands on the engine's ignition system. For example, increased cylinder pressure requires increased energy for igniting a spark across the gap of an ignition plug which, in turn, increases the rate of ignition plug electrode erosion and corresponding degradation in engine performance. It has been found, however, that when operating at high cylinder pressures, once the spark is established, i.e. once current begins to flow in an ionized spark gap, the remaining energy stored in the ignition coil contributes very little to the combustion event but contributes greatly to electrode erosion. It is accordingly a goal of system 300 to reduce post-spark energy stored in the ignition system. System 300 is preferably used to minimize or at least decrease electrode erosion in a conventional spark plug, but may alternatively be adapted for use in minimizing or at least decreasing electrode erosion in an arc-propelling plug such as that described hereinabove.

In any case, system 300 includes an ignition coil comprising a primary coil 102 coupled to a secondary coil 104, as is known in the art, wherein the ignition coil forms part of an ignition system for an internal combustion engine. System 300 also includes an ignition plug 302 having a first electrode connected to one end 104*a* of secondary coil 104 and a second electrode connected to an opposite end 104*b* of secondary coil 104 referenced at ground potential, wherein the ignition plug electrodes define a spark gap 304 therebetween. As described hereinabove, ignition plug 304 is, in one embodiment, a conventional ignition plug, but may alternatively be an arc-propelling ignition plug of known construction.

One end of the primary coil 102 is connected to a voltage source V and to one end of a switch 310, and the opposite end of voltage source V is connected to one end of a switch 306. An opposite end of switch 306 is connected to the opposite end of the primary coil 102 and to the opposite end of switch 310, and a control input of switch 306 is connected to a signal path 308 leading from an output OUT1 of control computer 112. Control computer 112 is preferably identical to that described with respect to FIGS. 7 and 11. A control input of switch 310 is connected to a signal path 312 leading from an output OUT2 of control computer 112. Switches 306 and 310 are, in one embodiment, field effect transistors (MOSFETs, JFETs or the like) having their gates connected to signal paths 308 and 312 respectively, or bipolar transistors having their bases connected to signal paths 308 and 312 respectively, but it is to be understood that switches 306 an 310 may alternatively be any electronically controllable device, such as a relay or the like, that is operable to controllably conduct current therethrough. In any event, control computer 112 is operable, in accordance with the present invention, to control switches 306 and 310 to thereby control current flow across the gap 304 of ignition plug 302 in such a manner as to effectuate proper combustion while minimizing ignition plug electrode erosion, as will be more fully described hereinafter.

System 300 may further include a spark voltage sensor 110 and variable resistor 118, as shown in phantom in FIG. 13, wherein sensor 110 and resistor 118 are identical in structure and operation to like components described with respect to FIGS. 7 and 11. If included in system 300, spark voltage sensor 110 has an input connected to end 104*a* of secondary coil 104 and an output connected to input IN of control computer 112 via signal path 114, and variable resistor 118 is connected across spark gap 304 and has a control input connected to output OUT3 of control computer 112 via signal path 120. Components 110 and 118 may optionally be used in system 300 to decrease the current level through ignition plug 302 below a threshold current level, after a spark is established across spark gap 304, in a manner identical to that described hereinabove with respect to FIGS. 712 to thereby further control the erosion rate of the ignition plug electrodes. Those skilled in the art will recognize that system 300 is not limited to an inductive type ignition system, and that the concepts of the present invention are applicable to other ignition system types such as, for example, capacitive systems.

Figures 14, 15, 16:
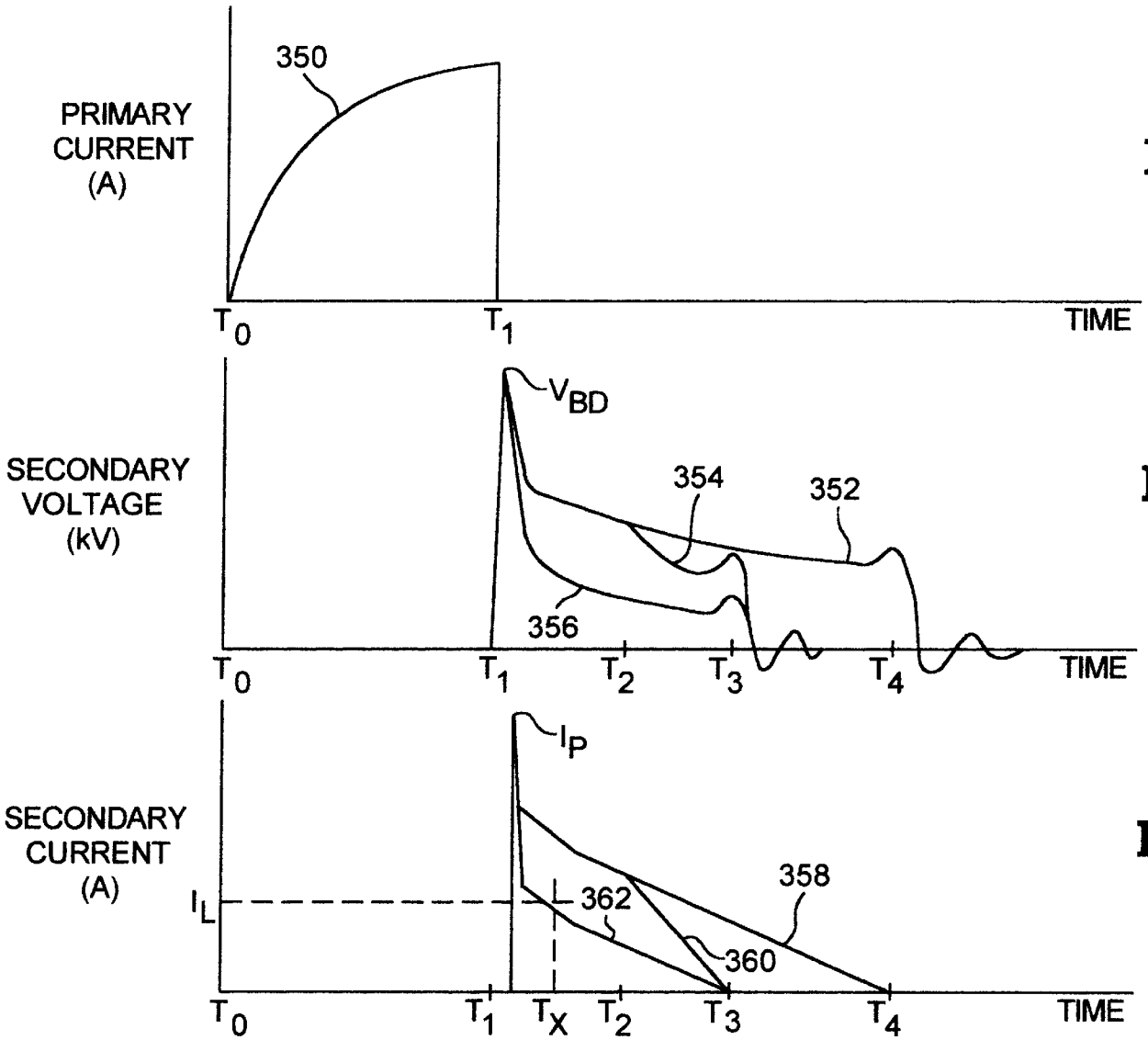
FIG. 14 is a plot of primary coil current vs. time for the system shown in FIG. 13.
FIG. 15 is a plot of secondary coil voltage vs. time for the system shown in FIG. 13 illustrating some of the spark energy control techniques of the present invention.
FIG. 16 is a plot of secondary coil current vs. time for the system shown in FIG. 13 illustrating some of the spark plug energy control techniques of the present invention.

Referring now to FIGS. 14–16, the operation of system 300 of FIG. 13 will now be described in detail. Under conventional operating conditions; i.e. without switch 310, sensor 110 or resistor 118, switch 306 for a so-called dwell time to thereby charge the primary coil 102. FIG. 14 illustrates a typical primary current waveform 350 during the dwell time occurring between $T_0$ and $T_1$. At $T_1$, switch 306 is opened and the flux response of the ignition coil couples the energy in the primary coil 102 to the secondary coil 104 as is known in the art. The secondary coil 104 is preferably configured to step up the voltage across the primary coil 102 by some desired ratio, an example of which may be 100:1 (secondary voltage to primary voltage ratio). As the energy in the primary coil 102 is coupled to the secondary coil 104 at $T_1$, the potential across the spark gap 302 increases until the air-fuel mixture between the gap 302 ionizes. This ionization potential is typically referred to as the spark gap breakdown voltage $V_{BD}$ and is illustrated in FIG. 15. The ionization of the spark gap 302 is followed directly by current flow through the now ionized channel established between the electrodes of ignition plug 302, as illustrated in FIG. 16, whereby this current flow beginning just after $T_1$ begins an in-cylinder combustion event.

Transfer of energy between the primary coil 102 and secondary coil 104 following the dwell time ($T_0$–$T_1$) begins at $T_1$ and lasts for some time period shown arbitrarily in FIGS. 15 and 16 as $T_1$–T4. Thus, under conventional operating conditions, the primary coil 102 is operable to induce a secondary voltage 352 which begins at $T_1$, ramps initially to a peak value $V_{BD}$ and thereafter decays until energy transfer is complete at $T_4$. The spark voltage 352 results in a current flow through secondary coil 104 as illustrated by secondary current waveform 358 of FIG. 16. The secondary current waveform begins slightly after $T_1$ (after ionization of the ignition plug gap 304 as described hereinabove), ramps initially to a peak value $I_p$ and thereafter decays until energy transfer between primary coil 102 and secondary coil 204 is complete at $T_4$.

The present invention recognizes that once current flow is established across spark gap 304 of ignition plug 302 in a high pressure environment (just after $T_1$), most of the remaining energy transfer between primary coil 102 and secondary coil 104 (up to $T_4$) contributes very little to the combustion event, but contributes greatly to erosion of the electrodes of ignition plug 302. Control computer 112 is therefore operable, in accordance with the present invention, to close switch 310, preferably at a time $T_2$ following ionization of, and subsequent current flow through, gap 304, to thereby cause the remaining energy stored in the primary coil 102 to be absorbed by primary coil 102 and/or discharged through switch 310. A resulting spark voltage waveform 354 is illustrated in FIG. 15, wherein control computer 112 is operable to close switch 306 at time $T_2$, which results in a faster decay rate of the voltage across secondary coil 104 and complete dissipation of the ignition coil energy by $T_3$. The net effect is that the spark voltage waveform 354 is shortened in duration over the conventional spark voltage waveform 352 while retaining essentially the same shape. The corresponding secondary current waveform 360 (discharge current across gap 304 of ignition plug 302) likewise begins a quicker decay at time $T_2$ and decays substantially completely by time $T_3$ as illustrated in FIG. 16. By shortening the duration of secondary current flow (discharge current through plug 302) from $T_1$+(slightly after $T_1$) through $T_4$ to $T_1 \pm T_3$, the erosion rate of the electrodes of ignition plug 302 may be minimized, or at least greatly reduced, while sacrificing very little in terms of combustion quality.

Control computer 112 may, in accordance with the present invention, be configured to determine the appropriate time $T_2$ to close switch 310 according to any one or more techniques. For example, control computer 112 may be operable to close switch 310 at some predefined time period following the controlled opening of switch 306, wherein the predetermined time period is preferably based on estimated or determined cylinder pressure conditions. In other words, a time delay DT may be stored in memory 146 as some predetermined delay period, and control computer 112 may be programmed to accordingly close switch 310 at $T_1$+DT. Alternatively, system 300 may include spark voltage sensor 110 wherein control computer 112 is operable to determine dynamic cylinder pressure from equation (1) above. Control computer 112 may, in such an embodiment, have a map, look-up table, one or more equations, and/or graphical representation relating cylinder pressure values to appropriate $T_2$ values (or appropriate DT values). In operation, control computer 112 is accordingly operable to monitor the spark voltage waveform provided thereto on signal path 114, determine therefrom a current value of cylinder pressure, and determine from the current cylinder pressure value an appropriate time $T_2$ at which to close switch 310. Those skilled in the art will recognize other techniques for determining an appropriate time $T_2$ at which to close switch 310, wherein such techniques preferably relate $T_2$ to cylinder pressure conditions, and will further recognize that such other techniques fall within the scope of the present invention.

In accordance with another aspect of the present invention, system 300 may further include sensor 110 and variable resistor 118, whereby control computer 112 is operable, in addition to controlling switch 310 as just described, to control the ignition plug discharge current to below some predefined level within some time period following gap ionization or initial current flow across gap 304. In accordance with one or more techniques described hereinabove with respect to FIGS. 7–12, control computer 12 is operable in this embodiment to determine an appropriate value of variable resistor 118, and to control resistor 118 to this appropriate value, to reduce the discharge current (secondary current) to below a predefined current limit $I_L$ within some predefined time period $T_x$ after energy transfer between the primary coil 102 and secondary coil 104 begins as shown by the secondary voltage waveform 356 of FIG. 15 and the secondary current waveform 362 of FIG. 16. In one embodiment, the time period $T_x$ is measured from $T_1$. Alternatively, the time period $T_x$ is measured from the time at which gap ionization occurs (detection of $V_{BD}$) as described hereinabove. In either case, the rate of erosion of the electrodes of ignition plug 304 may be further reduced, and possibly minimized, by the combined control of the duration of discharge (secondary) current flow and the magnitude of the discharge (secondary) current within some predefined time period after the transfer of energy from the primary coil 102 to the secondary coil 104 begins.

While the invention has been illustrated and described in detail in the foregoing drawings and description, the same is to be considered as illustrative and not restrictive in character, it being understood that only the preferred embodiments thereof have been shown and described and that all changes and modifications that come within the spirit of the invention are desired to be protected.

What is claimed is:

1. A system for controlling ignition energy of an internal combustion engine, comprising:

an ignition coil having a primary coil coupled to a secondary coil, said primary coil responsive to a control voltage to induce a spark voltage across said secondary coil;

means responsive to a shunting signal for electrically shorting said primary coil; and a control computer producing said shunting signal after said spark voltage is induced across said secondary coil, said primary coil thereafter absorbing said spark voltage and accordingly reducing a duration of said spark voltage induced across said secondary coil.

2. The system of claim 1 further including means for sensing said spark voltage and producing a spark voltage signal corresponding thereto;

and wherein said control computer is responsive to said spark voltage signal to control production of said shunting signal.

3. The system of claim 2 wherein said spark voltage signal defines a breakdown voltage;

and wherein said control computer is operable to produce said shunting signal within a first time period after said voltage signal exhibits said breakdown voltage.

4. The system of claim 3 further including an ignition plug having first and second electrodes connected across said secondary coil and defining a spark gap therebetween;

wherein said breakdown voltage of said spark voltage is operable to ionize said spark gap and produce a discharge current between said first and second electrodes.

5. The system of claim 4 further including a resistor connected across said spark gap and sized to limit said discharge current below a first threshold current within a second time period after said voltage signal exhibits said breakdown voltage.

6. The system of claim 5 wherein said resistor is a variable resistor responsive to a resistor control signal to vary a value of said resistor;

and wherein said control computer is responsive to said spark voltage signal to produce said resistor control signal as a function thereof to thereby control said variable resistor to a suitable resistance value for limiting said discharge current below said first threshold current within said second time period after said voltage signal exhibits said breakdown voltage.

7. The system of claim 6 further including:

a supply voltage; and means responsive to an ignition control signal for connecting said supply voltage across said primary coil to thereby produce said control voltage there across.

8. The system of claim 7 wherein said control computer is operable to produce said ignition control signal.

9. The system of claim 1 further including an ignition plug having first and second electrodes connected across said secondary coil and defining a spark gap therebetween;

wherein said spark voltage is operable to ionize said spark gap and produce a discharge current between said first and second electrodes.

10. The system of claim 9 further including a resistor connected across said spark gap and sized to limit said discharge current below a first threshold current within a first time period after said spark voltage ionizes said spark gap.

11. The system of claim 10 wherein said resistor is a variable resistor responsive to a resistor control signal to vary a value of said resistor;

and wherein said control computer is operable to produce said resistor control signal as a function of said spark voltage to thereby control said variable resistor to a suitable resistance value for limiting said discharge current below said first threshold current within said first time period after said spark voltage ionizes said spark gap.

12. The system of claim 11 further including means responsive to said spark voltage for producing a spark voltage signal corresponding thereto;

and wherein said control computer is responsive to said spark voltage signal to produce said shunting signal and said resistor control signal as functions thereof.

13. The system of claim 11 further including:

a supply voltage; and means responsive to an ignition control signal for connecting said supply voltage across said primary coil to thereby produce said control voltage there across.

14. The system of claim 13 wherein said control computer is operable to produce said ignition control signal.

* * * * *